US006784848B2

(12) United States Patent
Harris

(10) Patent No.: US 6,784,848 B2
(45) Date of Patent: Aug. 31, 2004

(54) BROAD BAND SLOT STYLE TELEVISION BROADCAST ANTENNA

(75) Inventor: George Harris, Auburn, ME (US)

(73) Assignee: RF Technologies Corporation, Lewiston, ME (US)

( * ) Notice: Subject to any disclaimer, the term of this patent is extended or adjusted under 35 U.S.C. 154(b) by 0 days.

(21) Appl. No.: 10/282,701

(22) Filed: Oct. 29, 2002

(65) Prior Publication Data

US 2003/0080913 A1 May 1, 2003

Related U.S. Application Data

(60) Provisional application No. 60/351,285, filed on Oct. 29, 2001.

(51) Int. Cl.[7] ..... H01Q 9/04
(52) U.S. Cl. ..... 343/791; 343/770
(58) Field of Search ..... 343/767, 770, 343/790, 791, 890, 891

(56) References Cited

U.S. PATENT DOCUMENTS

| | | | | | |
|---|---|---|---|---|---|
| 2,756,421 | A | * | 7/1956 | Harvey et al. | 343/770 |
| 4,763,130 | A | * | 8/1988 | Weinstein | 343/770 |
| 4,899,165 | A | * | 2/1990 | Schadler | 343/767 |
| 5,220,337 | A | * | 6/1993 | Ajioka | 343/770 |
| 5,546,096 | A | * | 8/1996 | Wada | 343/771 |
| 5,870,061 | A | * | 2/1999 | Casciola et al. | 343/771 |
| 5,917,454 | A | * | 6/1999 | Hill et al. | 343/769 |
| 5,929,821 | A | * | 7/1999 | Goldstein et al. | 343/770 |
| 6,313,806 | B1 | * | 11/2001 | Schadler | 343/767 |
| 6,373,444 | B1 | * | 4/2002 | Schadler | 343/770 |

* cited by examiner

*Primary Examiner*—Tan Ho
(74) *Attorney, Agent, or Firm*—Lightbody & Lucas

(57) ABSTRACT

A broad band slot style broadcast antenna utilizing coaxial hollow tubes, the inner tube discontinuous at its longitudinal center in order to provide two high power antennas at a single location. The outer tube has slots accompanying adjustable electromagnetic coupling structures.

15 Claims, 4 Drawing Sheets

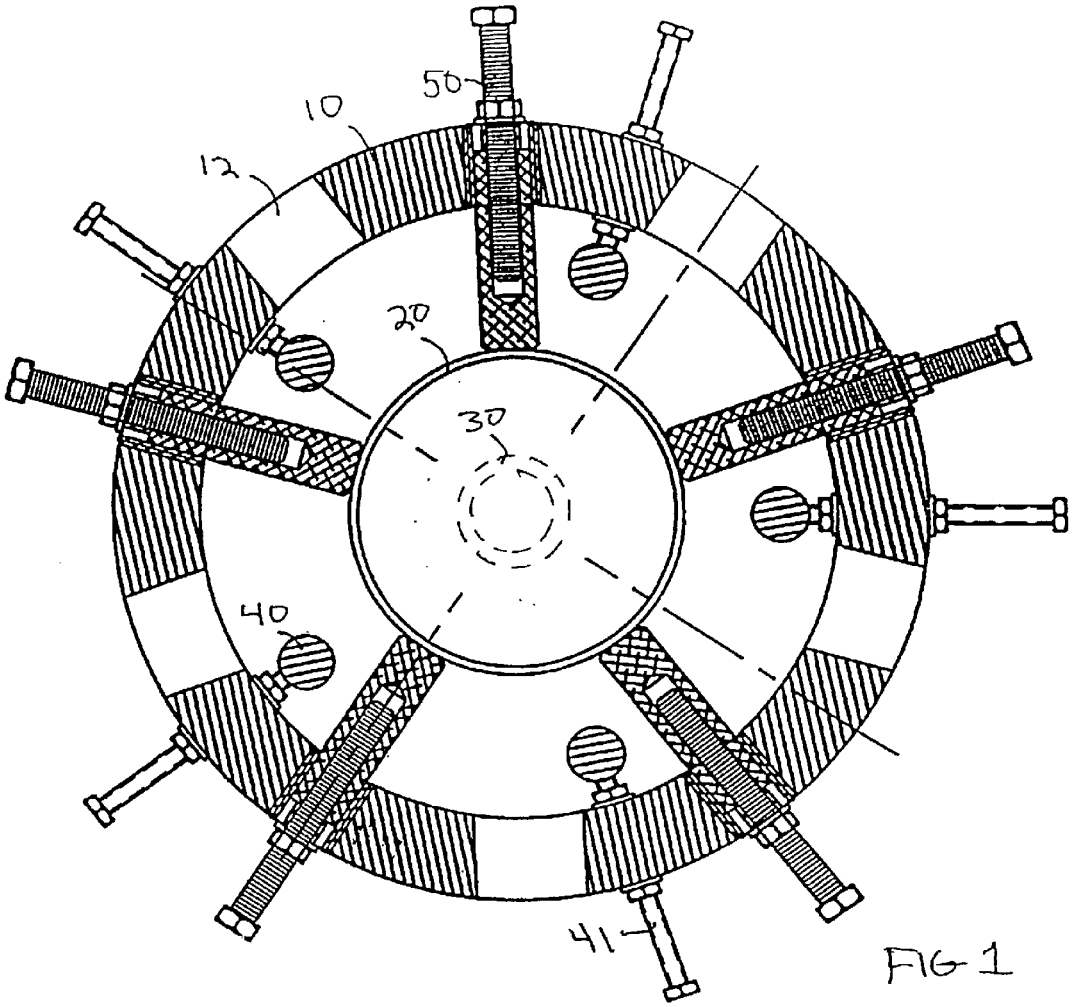
FIG-1
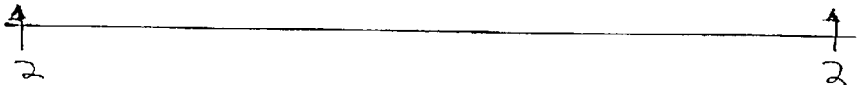

BROAD BAND SLOT STYLE TELEVISION BROADCAST ANTENNA

This application Claims the benefit of Provisional Application Ser. No. 60/351,285 filed Oct. 29, 2001.

FIELD OF THE INVENTION

This Invention relates to a broad band digital and/or analog high-power broadcast antenna for signals. A dual-adjacent channel television antenna is disclosed.

BACKGROUND OF THE INVENTION

A high-power U.H.F. television broadcast transmitting station requires and includes complete transmitting facilities, as well as an antenna that is mounted atop a tall supporting structure. The antenna is responsible for directing the transmitted signals that carry the television pictures and sound and/or other signals to an audience. It is the job of the antenna to focus the signals toward the audience. In order to operate properly, the antenna must precisely match the required electrical conditions that attend a particular frequency associated with the operating channel(s). For example television channels are assigned by the Federal Communications Commission in the U.S., and by similar governmental agencies in other countries throughout the world. Traditionally, each television antenna is designed and built to operate over a single channel that is 6.0 MHz wide. Once the antenna is built, that operating frequency is fixed and cannot practically be changes. As the country and the world changes from analog to digital technology, and as existing television channel frequencies are re-assigned to other services, most television stations will be required to change both the mode of operation, i.e. from analog to digital transmission, and to be assigned new operating channels in the U.H.F. television frequency band. In many cases, through either an interim channel assignment and/or a requirement for simultaneous digital and analog television broadcasts, there is a requirement for the broadcast of multiple television channels from the same transmitting site at the same time. Many of these channel assignments are adjacent to one another. This fact then generates a need for a high power antenna that can be used to transmit the channels simultaneously, while at the same time, providing the required electrical parameters to the television transmitting equipment over channels. For example, this would require an antenna that will operate over 12.0 MHz of the television broadcast band for two channels and not the 6.0 MHz band for a single channel. With appropriate television transmitter combining equipment, a single antenna and transmission line may be used to simultaneously transmit the two adjacent channels at the same transmitting site. This invention covers the engineering and design of the high-power transmitting antenna that has both the electrical bandwidth to simultaneously accommodate up to two adjacent 6.0 MHz television channels, while at the same time, providing the appropriate power tolerance and antenna gain to implement the antenna system for up to two full-power television channels. This antenna invention will accommodate two digital channels, two analog-channels or one digital and one analog channel.

OBJECTS AND SUMMARY OF THE INVENTION

Virtually every television broadcast station in the United States, and then in most other countries throughout the world must convert from the older analog television broadcast mode to the new, high definition digital television broadcast mode. Most of these television stations will have to change their operating frequency, as well as switch from the analog to the new digital mode. This transition process is expected to be completed over a number of years. In many cases, the transition process will involve the broadcast of the new high-definition digital television signals, while at the same time, broadcasting the older analog television signals on a U.H.F. adjacent channel. This simulcast period will be necessary in order to allow time for the viewing audience acquire the necessary digital television sets. This simulcast process will require the use of two separate television channels, each occupying six megahertz of frequency bandwidth. Traditionally, television stations would install a transmitting antenna designed to handle the single 6.0 MHz channel assigned to that particular station. In addition, some television stations desire to share broadcasting facilities in order to reduce the cost of the required transition. In either case, most antenna systems in place now for the single stations are designed to operate on a single assigned channel.

This particular invention covers a new, simple, cost effective implementation of a full, high-power U.H.F. television broadcast antenna system that is fully capable of handling two adjacent 6.0 MHz television channels simultaneously.

It is an object of this invention to increase the efficiency of usage of each antenna transmitting facility;

It is another object of this invention to reduce the complexity of the antenna systems for television broadcast stations;

It is another object of this invention to provide a television broadcast antenna system that will transmit two adjacent television channels simultaneously using the same antenna and transmission line;

It is another object of this invention to reduce the number of antenna systems that are required for the number of operating television channels;

It is another object of this invention to allow two separate television broadcasters to share a common antenna system;

It is another object of this invention to provide increased frequency bandwidth for single-channel stations.

It is another object of this invention to provide V.S.W.R. profiles that are nearly flat over the entire 12 MHz, two-channel operating band, in order to ensure high integrity transmission of digital signals;

Other objects and a more complete understanding of the invention may be had by referring to the following drawings in which:

BRIEF DESCRIPTION OF THE DRAWINGS

FIG. 1 is a cross-sectional view of a dual channel television transmitter embodiment of the invention taken along lines 1—1 in FIG. 2 showing the coaxial inner conductor, adjustable electromagnetic coupling structure as well as the adjustable reactance compensating capacitor/inner conductor centering structure;

DETAILED DESCRIPTION OF THE INVENTION

Figure 2:
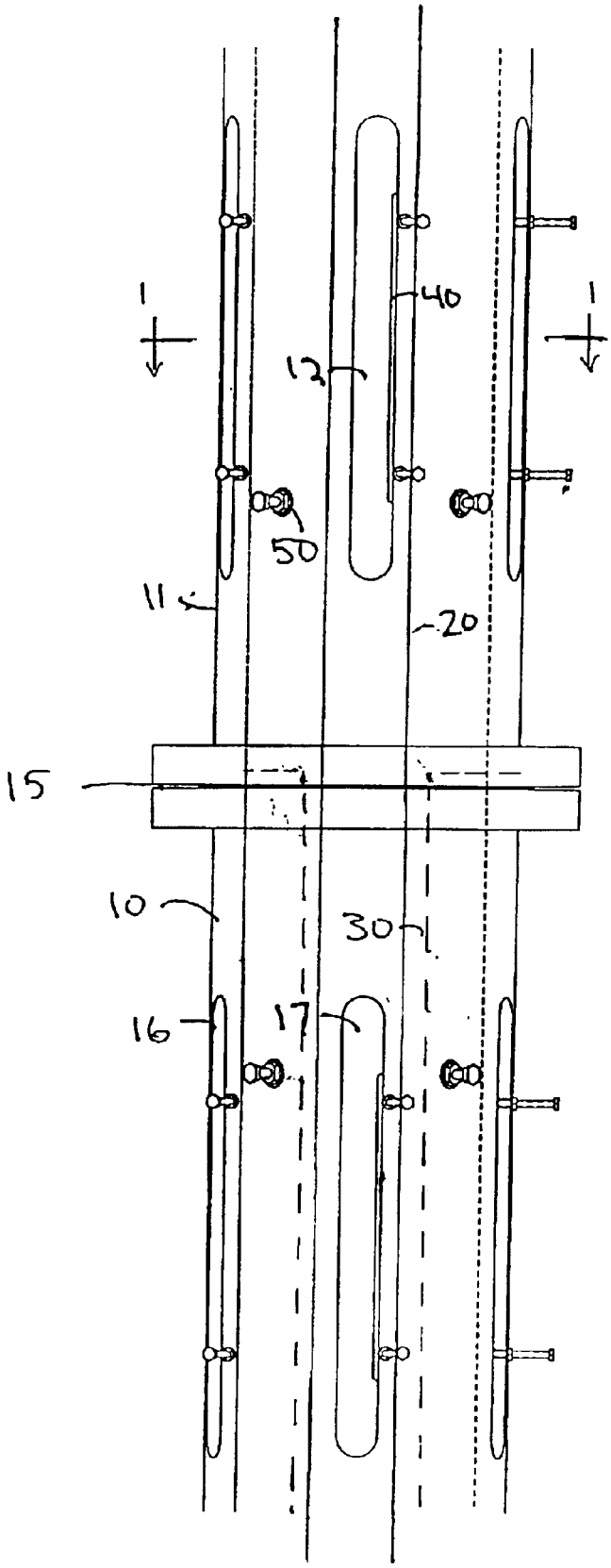
FIG. 2 is a side view of the embodiment of FIG. 1 taken from line 2—2 therein with the optional protective non-conductive radome cylinder removed and the inner structure in dashed lines.
Figure 3:
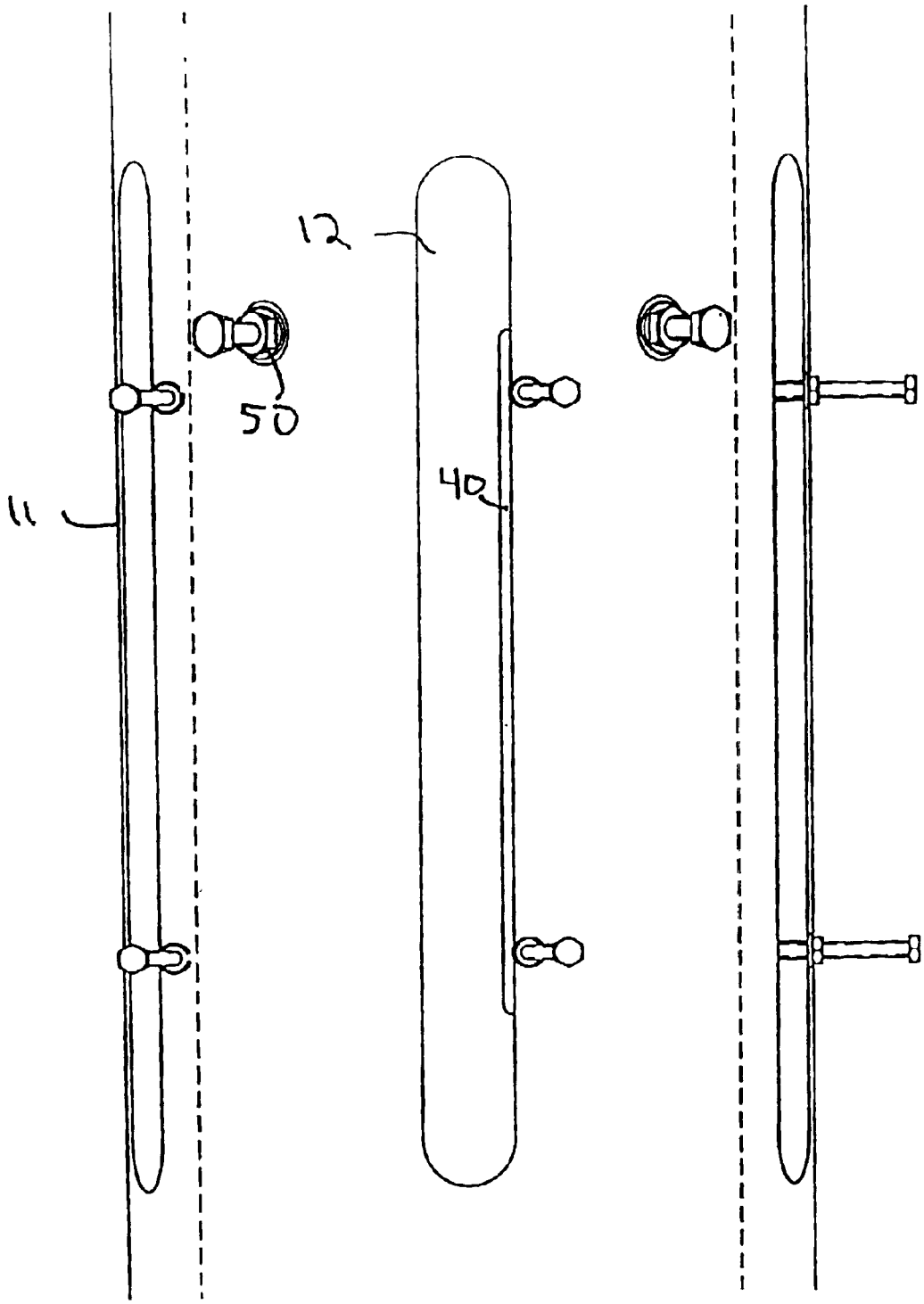
FIG. 3 is a closer view of one of the television signal radiating slots of FIG. 2, showing both the adjustable electromagnetic coupling structure as well as the adjustable reactance compensating capacitor/inner conductor centering structure.

There are many television broadcast stations around the world where a cost-effective broad band high power television antenna would be very desirable, if not required. With todays increasing difficulties from local zoning boards and conservation groups, the ability to consolidate the number of television antennas and supporting towers becomes more and more necessary. In addition, using a single antenna to transmit up to two separate television channels simultaneously would allow two television stations to reduce their costs for an antenna and supporting tower system, while at the same time, pooling their resources in order to support a state-of-the-art tower and antenna system. As discussed above, the ability of this invention to transmit two television broadcasts simultaneously will benefit a single television station who is required to carry both the new digital broadcast format, as well as the older analog broadcast format.

The present invention covers a network that offers nearly flat V.S.W.R. profiles over two contiguous television channels. This invention also is designed to permit the high power signals transmitted by television stations with licensed effective radiated power levels of up to the maximum allowed one million watts per channel.

In the present invention, a smaller metallic pipe 20 is installed inside of another larger metallic pipe 10, so as to form a coaxial structure. This entire structure supports wave propagation in the transverse electromagnetic, (TEM), mode. The ratio of the two pipe diameters are selected so that the TEM Mode surge impedance, as calculated by the formula, (with the impedance given in Ohms):

$$Zs=60*\log_e((\text{Inside Diameter of Outer Tube})/(\text{Outside Diameter of Inner Tube}))$$

This is designed to be nearly equal to 38 Ohms. This invention is designed such that the entire structure is excited and fed from the center of the antenna. The inner conductor of the antenna is therefore discontinuous at the center. Since most of these antennas are designed to be mounted onto the top of a supporting tower, the transmission line that feeds the antenna from the television station's transmitter must be connected at the base or below the base of the antenna. This is accomplished by allowing the lower half of the inner conductor of the invention to act both as the inner coaxial conductor for the antenna, as well as the outer coaxial feed section for the antenna.

A series of adjustable reactance compensating centering structures 50 provides for the centering of the inner smaller pipe 20 in respect to the larger outer pipe 10. Each structure is substantially centered between adjoining slots.

A third pipe 30 whose diameter is smaller than the inside diameter of the inner conductor pipe in the lower half of the antenna is inserter in a coaxial fashion, and extends up into the antenna to the center of the structure. The outside diameter of this third inner conductor feed section is sized such that the surge impedance, as calculated using the above formula is equal to approximately 30 Ohms. This 30 Ohm surge impedance of the lower half feed section is selected so as to allow for the highest signal power capability in the TEM mode, such that the antenna may be operated reliably while carrying two simultaneous full-power television stations.

At the base of the antenna, a synchronous one-quarter wavelength transformer section is installed onto the bottom end of the 30 Ohm feed section in order to connect the input terminals of the antenna to standard transmission line surge impedance values of 50 Ohms or 75 Ohms.

At the center of the antenna, a dividing insulator 15 is installed such that the signals that are incident from the transmitter(s) will divide in half. One half of the signal power will flow up from the center on the outside surface of the antenna inner conductor in the top half 11 of the antenna toward the top of the structure, and the remaining half of the signal power will flow from the center on the outside surface of the inner conductor down toward the bottom half 15 of the antenna.

At the center insulator where this signal divides, the magnitudes of the power levels are approximately 50%/50%, (assuming that the two halves of the antenna are identically tuned, and present the same impedance value to the electrical center of the antenna. With this type of feed system, the phases of the two divided signals are 180 degrees different. Since each half of this invention must be fed in relative phase equality, the 180 degree phase difference may be compensated for by offsetting the centerfeed insulator position by approximately one-quarter of a wavelength at the band center design frequency. Another phase compensation method may be implemented by coupling to each radiating slot or radiating center on the opposite side of the slots on the top half of the antenna as opposed to the bottom half.

The outer conductor of the antenna contains long slots 12, 17, positioned one or more at each position along the long axis of the antenna, that are cut vertically along the long axis of the outside tube. These slots are approximately 0.75 of a free space wavelength long at the center frequency of the operating frequency band. The width of each slot is approximately 0.0681 times the free space wavelength at the center frequency of the operating band. The center-to-center spacing between the slot clusters at each level is approximately 0.976 times the free space wavelength of the center frequency of the operating frequency band. The number of slot levels along the entire antenna is usually no more than 22, and no less than 18. The number and position of slots per level is determined by the desired azimuth pattern of the particular antenna. For an azimuth pattern that is desired to be nearly omni-directional, there are usually five slots per slot level. In this omni-directional pattern example, the five slots are positioned equally around the outside of the outer antenna tube.

In some antennas, azimuth directional patterns are required. This may require radiating slots with their electromagnetic coupling structures to be placed through the pylon that are not symmetrically placed around the pylon. This results in a directional azimuth pattern. Symmetry of the electromagnetic fields inside of the coaxial pylon antenna needs to be maintained. The presence of radiating slots and coupling structures that are not symmetrically placed around the pylon will disturb the symmetry of the internal electromagnetic fields. Symmetricising structures, such as rods or bars can be plates at even intervals around the inside of the pylon in order to compensate for the asymmetrical electromagnetic field disturbance caused by the directional radiating slots in direction antennas. A symmetricising structure can be similar to a coupling structure disclosed herein extended at its otherwise normal position (without adjoining slot).

In the TEM signal propagation mode, voltage potential differences exist on the outside surface of the inner conductor tubes inside of the slotted antenna. These voltages will give rise to electric fields that extend radially outward from the inner conductor to the inside surface of the outer antenna tube. In addition, currents flowing on the outside surface of the inner conductor tubes inside-of the slotted antenna will give rise to magnetic fields that encircle the inner tube. Both of these fields then interact with special coupling structures that are mounted to the inside surface of the outer antenna tube, directly adjacent to each radiating slot.

The coupling structures 40 are fabricated from round cross-section brass or aluminum material. Each coupling structure is made to be approximately 0.493 of a wavelength long, at the center frequency of the operating frequency band. The coupling structures diameter are approximately 0.034 times the wavelength of the center frequency of the operating frequency band. Each coupling structure is mounted adjacent to each radiating slot using two threaded rods 41, nuts and washers designed for proper current transfer contact to the inside surface of the outer conductor tube of the antenna, adjacent to each radiating slot. Each of the two tap points on the coupling structures for the threaded rod mounting mechanism is located approximately 0.0568 times the wavelength of the center frequency of the operating frequency band.

For this invention, the threaded rod mounting mechanism will allow for the adjustable positioning of the coupling structures adjacent to each radiating slot in the antenna. This relative position adjustment of the coupling structures allows for proper adjustment of radiating center impedance for the number of slots in the antenna, overall coupling for the required operating bandwidth as well as other parameters. This particular mounting method for the coupling structures creates a closed loop between the coupling structures, the mounting rods and the inside surface of the outer antenna tube adjacent to each slot. This closed loop described here will couple to magnetic field lines that result from currents that flow on the outside surface of the inner conductor tubes inside of the antenna. Additionally, since electric fields extend radially outward from the inner conductor tubes in the antenna toward the inner surface of the outer antenna tube, the presence of the metallic coupling structures will cause a distortion in the uniformity of the radial fields from antenna inner conductor. This resultant distortion will electrically induce current flow in the coupling structures.

These electromagnetically induced currents in the in the coupling structures are passed on to the slots through the two adjustable threaded mounting rods that engage two small mounting slots that are cut into one side of each radiating slot. This coupling structure mounting approach makes installation and removal and adjustment of the coupling structures very easy. At the exact center of each radiating slot, the conduction currents that flow along the edge of the slot are nearly zero, due to the vector addition of the slot currents that flow in nearly equal magnitudes and opposite directions at the slot centers. At this same point on the slot, the voltage across the slot is at a maximum due to the relative current directions being opposite of one another from one side of the slot to the other. The standing wave impedance at the electrical center of each slot is position-dependent. The impedance value is equal to the voltage across the slot divided by the conduction current along the edge of the slot. This impedance value is highest at specifically the slot center, as the conduction current is minimum and the voltage across the slot is at a maximum. As the impedance is evaluated at positions along the slot moving away from the center and toward the ends, its value decreases. This impedance goes to a minimum at the ends of the slot. At the slots ends, the voltage across the slot is nearly zero because the end of the slot is essentially a short circuit, while the conduction currents are completely supported and are nearly maximum at this point. Coupling the drive currents to the slots from the coupling structures is done through the adjustable mounting structures. This is done at a specific physical position on the coupling structure and the slot so that the ratio between the driving or source impedance from the coupling structures, and the load impedance at the slots results in approximately a 10%–15% over-coupled condition at the center frequency of the operating frequency band, in order to allow enough V.S.W.R. bandwidth for the simultaneous operation of two standard 6.0 MHz television channels. As disclosed above, the mechanical dimension from each end of the coupling structures to the current feed point, (tap), point on the radiating slot for this invention is approximately 0.0568 times the free-space wavelength at the center frequency of the operating frequency band of the invention.

Figure 5:
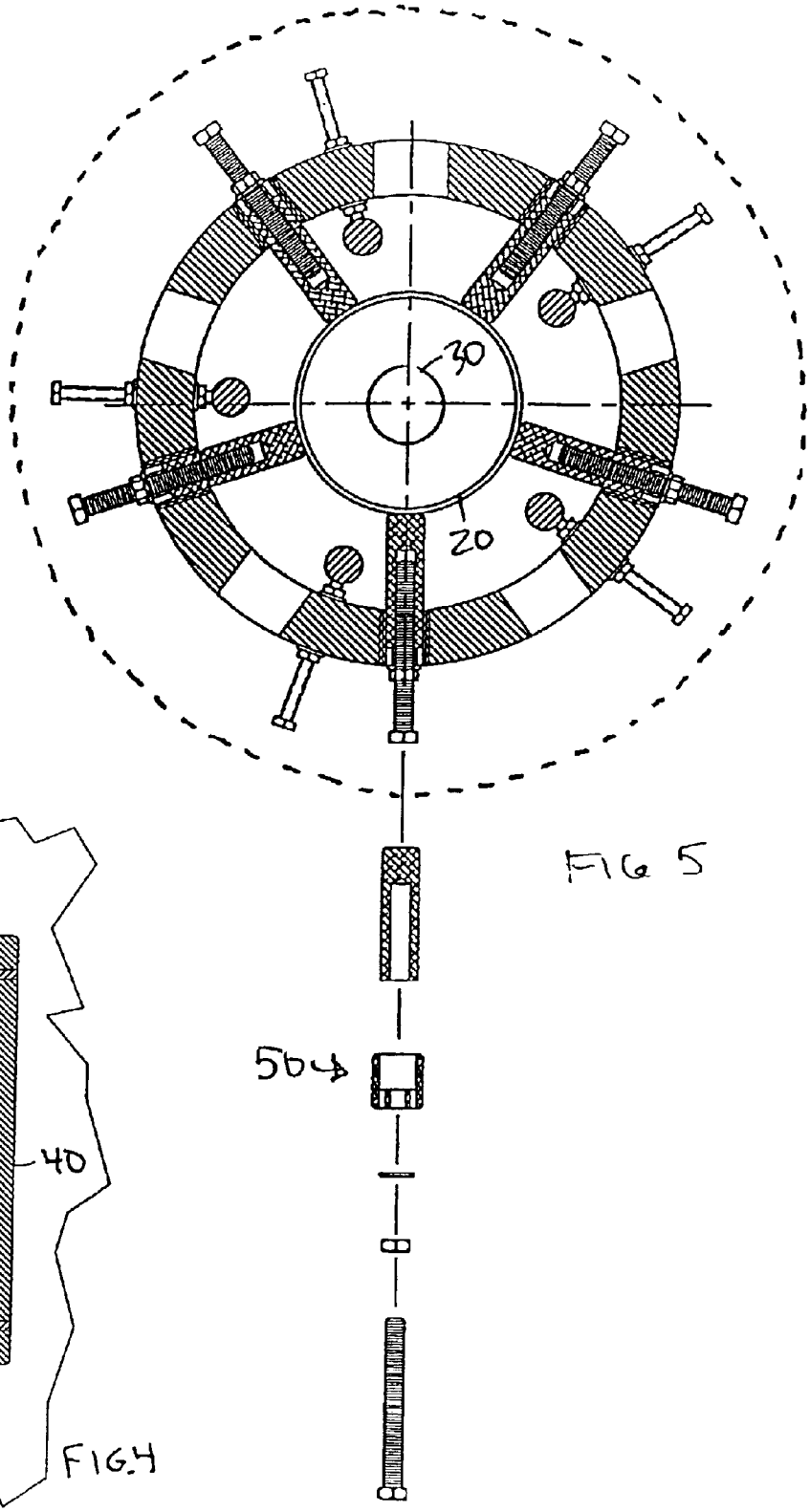
Figure 4:
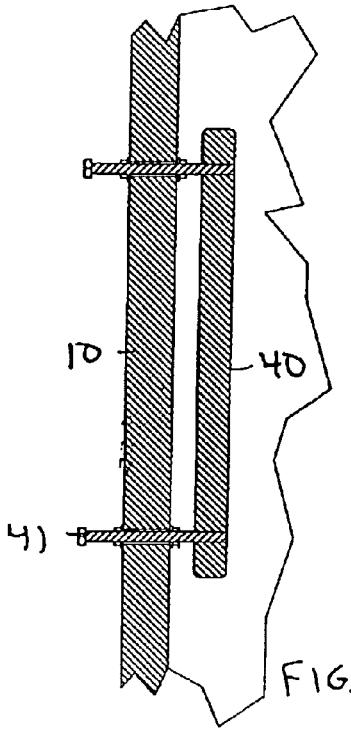
FIG. 4 is a cut-away cross-sectional view of the electromagnetic coupling structure, coupling structure adjustment and clamping mechanism and illustrated drive current tap points associated with each radiating slot of FIG. 1; and, FIG. 5 is a view like FIG. 1 including detail of the centering/compensating structures that are installed at each slot cluster level.

The coupled impedance of the properly tuned slot cluster at each level on the antenna, as referenced at the electrical center of each radiating slot cluster contains a small capacitive reactance component due to the perturbation of the electric TEM mode electric fields at each slot cluster along the antenna. In order to neutralize this condition, mechanical centering/compensating structures are installed from the outside of the antenna. These structures are completely adjustable for both the proper mechanical centering of the inner conductor in the antenna, as well as for the proper amount of electrical compensation. These structures are fabricated from ceramic or Teflon. They are adjustable from the outside surface of the invention for proper centering of the inner conductor. Capacitive compensation adjustment screws are then threaded through the brass centering/compensation structure mounting bushing. These adjustment screws may either be threaded further in toward the inner conductor for more capacitive compensation if required, or backed out thus reducing the amount of capacitive compensation. This adjustment is made during electrical tuning of the antenna, and, as can be seen from FIG. 5, does not affect the mechanical centering of the inner conductor. These two adjustments must be, and can be made completely independently. Since the slot cluster impedance is adjusted to have a slightly capacitive component, as mentioned above, and the centering/compensation structures described here also present an adjustable capacitive reactance, the longitudinal separation between the center of each slot cluster along the long axis of the invention, and the position of each of the centering/compensation structures is approximately one quarter of a wavelength at the center frequency of the operating frequency band from each slot cluster toward the feed end of the antenna. This one quarter wavelength separation described above will provide the required compensation. There is one centering/compensation structure for each slot in the slot cluster or level on the antenna. Each of these centering/compensation structures are placed angularly around the outside circumference of the invention approximately one half of the way between adjacent slots at each level or cluster.

The number of radiating slots at each slot cluster may be adjusted in order to produce the required azimuth radiation pattern. This number can range from one slot per level to several, (five or more). In the case of one or two slots per cluster or level, the minimum number of centering/compensation structures is three.

In order to protect the entire invention from degradation due to weather, the entire length of the antenna may be protected by a weather proof cylinder. This cylinder is designed to be installed in sections that wrap around and cover the entire antenna. The diameter of this protective cylinder is designed such that the inside diameter of the cylinder is approximately one quarter of a wavelength at the center frequency of the operating frequency band from the outside surface of the invention. This is done in order to reduce the capacitive loading and de-tuning effect of the material comprising the weather proof cylinder. This weather proof cylinder can be fabricated of high density polyethylene plastic material of approximately 3/16 of an inch thick. The weather proof cylinder material may also contain additives to produce the desired or required color for tall structure visibility requirements. The weather proof cylinder material also contains pigments and/or additives to stabilize it against degradation by ultraviolet radiation from the sun.

What is claimed is:

1. A broadcast antenna including a first tubular conductor, a second tubular conductor, said first conductor being inside said second conductor, a centering structure, said centering structure extending between said first and second tubular structures to align same, a series of slots, said series of slots extending through said second conductor, an electromagnetic coupler, said electromagnetic coupler being located adjacent to said slots, and said first conductor being discontinuous along its longitudinal axis.

2. The broadcast antenna of claim 1 characterized by the addition of a third conductor, said third conductor being inside said first conductor and joining with same at its discontinuity.

3. The broadcast antenna of claim 2 characterized in that it has a surge impedance to the first conductor.

4. The broadcast antenna of claim 1 characterized in that the antenna operates at two frequencies relative to said discontinuity.

5. A broadcast antenna including a first tubular conductor, a second tubular conductor, said first conductor being inside said second conductor, said first conductor being discontinuous substantially at its longitudinal center to create a split, a third conductor, said third conductor being inside said first conductor and joining with same at its split, a centering structure, said centering structure extending between said first and second tubular structures to align same, a series of slots, said series of slots extending through said second conductor, and electromagnetic coupler, said electromagnetic coupler being located adjacent to said slots.

6. The broadcast antenna of claim 5 characterized in that the relative diameters of the first and second tubular diameters is $Zs=60*\log_e$ (inside diameter of outer conductor/outside diameter of inner conductor).

7. The broadcast antenna of claim 6 characterized in that said series of slots extend circumferentially of said second tubular conductor, each slot being spaced center to adjoining slots by 0.976 times the free space wavelength at the center frequency of the operating band of the antenna.

8. The broadcast antenna of claim 7 characterized in that there are between 18 and 22 series of slots circumferentially of the antenna.

9. The broadcast antenna of claim 5 characterized in that said electromagnetic coupler is approximately 0.493 of the wavelength of the center frequency of the operating frequency band.

10. The broadcast antenna of claim 5 characterized in that said electromagnetic coupler is adjustably mounted to said second conductor.

11. The broadcast antenna of claim 10 characterized in that there are two rods extending between said electromagnetic coupler and said second conductor;

said coupler is mounted 0.0568 times the wavelength of the center frequency of the operating frequency band from said second conductor.

12. The broadcast antenna of claim 10 characterized in that there are two rods extending between each electromagnetic coupler and said second conductor.

13. The broadcast antenna of claim 5 characterized in that said electromagnetic coupler is round with a diameter 0.034 times the wavelength of the center frequency of the operating frequency band.

14. The broadcast antenna of claim 5 characterized in that said series of slots extend longitudinally of said second tubular conductor.

15. The broadcast antenna of claim 5 characterized in that said slots are 0.0681 times the free space wavelength at the center frequency of the operating band.

* * * * *